US011180346B2

(12) United States Patent
Thomas et al.

(10) Patent No.: US 11,180,346 B2
(45) Date of Patent: Nov. 23, 2021

(54) CAR FOR AN ELEVATOR IN AN ELEVATOR SHAFT

(71) Applicant: Inventio AG, Hergiswil (CH)

(72) Inventors: Heiko Thomas, Dresden (DE); Falk Burkhardt, Radeberg (DE); Michael Weigel, Heidenau (DE); Steffen Thon, Weinbohla (DE)

(73) Assignee: INVENTIO AG, Hergiswil NW (CH)

( * ) Notice: Subject to any disclaimer, the term of this patent is extended or adjusted under 35 U.S.C. 154(b) by 643 days.

(21) Appl. No.: 15/767,164

(22) PCT Filed: Oct. 12, 2016

(86) PCT No.: PCT/EP2016/074472
§ 371 (c)(1),
(2) Date: Apr. 10, 2018

(87) PCT Pub. No.: WO2017/064123
PCT Pub. Date: Apr. 20, 2017

(65) Prior Publication Data

US 2019/0071283 A1 Mar. 7, 2019

(30) Foreign Application Priority Data

Oct. 12, 2015 (DE) ..... 10 2015 117 360.3

(51) Int. Cl.
*B66B 11/02* (2006.01)
*B66B 7/08* (2006.01)
(Continued)

(52) U.S. Cl.
CPC ..... *B66B 11/0206* (2013.01); *B66B 7/08* (2013.01); *B66B 11/008* (2013.01);
(Continued)

(58) Field of Classification Search
CPC ..... B66B 11/0206; B66B 11/0226
See application file for complete search history.

(56) References Cited

U.S. PATENT DOCUMENTS

2004/0173411 A1* 9/2004 Silberhorn ..... B66B 11/0226 187/277
2011/0061978 A1 3/2011 Dominguez et al.
(Continued)

FOREIGN PATENT DOCUMENTS

DE 102005054022 A1 5/2007
DE 202016105627 U1 * 6/2017 ..... B66B 11/008
(Continued)

*Primary Examiner* — Diem M Tran
(74) *Attorney, Agent, or Firm* — William J. Clemens; Shumaker, Loop & Kendrick, LLP

(57) ABSTRACT

A car for an elevator in an elevator shaft is suspended substantially in the center of gravity thereof at least in a ratio of 2:1 by a carrying apparatus guided via pulleys and is guided through car guides. The car has a car base, a car roof and car walls that define a passenger space. For using the car in a machine room-free elevator, to provide a shaft cross-section as large as possible and to reduce the required shaft pit depth and/or the required shaft head height, at least a first part of one of the pulleys is located between the car base and the car roof and a second part of the pulley is located in the car base or at the same height as the car base or in the car roof or at the same height as the car roof.

13 Claims, 13 Drawing Sheets

(51) Int. Cl.
*B66B 11/00* (2006.01)
*B66B 15/04* (2006.01)

(52) U.S. Cl.
CPC ..... *B66B 11/0226* (2013.01); *B66B 15/04* (2013.01); *B66B 11/0065* (2013.01)

(56) References Cited

U.S. PATENT DOCUMENTS

| | | | | |
|---|---|---|---|---|
| 2011/0209318 | A1* | 9/2011 | Fischer | B66B 19/002 29/401.1 |
| 2015/0158697 | A1* | 6/2015 | Zapf | B66B 5/0031 187/266 |
| 2016/0159615 | A1* | 6/2016 | Maruyama | B66B 11/0206 187/266 |

FOREIGN PATENT DOCUMENTS

| | | | |
|---|---|---|---|
| EP | 866018 | A1 * | 1/1997 |
| EP | 1457454 | A1 | 9/2004 |
| EP | 1566358 | A1 | 8/2005 |
| EP | 1626026 | A2 | 2/2006 |
| EP | 1818303 | A1 | 8/2007 |
| EP | 1970341 | A1 | 9/2008 |
| WO | 2004078628 | A2 | 9/2004 |

* cited by examiner

CAR FOR AN ELEVATOR IN AN ELEVATOR SHAFT

FIELD

The invention relates to a car for an elevator in an elevator shaft, which car is suspended substantially in the center of gravity thereof at least in a ratio of 2:1 by means of carrying means guided via pulleys.

BACKGROUND

The dimensions of elevator systems with cars suspended from carrying means are significantly influenced by the types of carrying means arrangements. One disadvantage of known mechanisms in particular is that pulleys arranged outside of the elevator car require a great shaft head height, a great shaft width, and/or a deeper shaft pit. With a car suspended at least in a ratio of 2:1 with a carrying means guide below or above the car, the pulleys require space below or above the car respectively.

EP 1 566 358 A1 describes a machine room-free traction drive elevator, in which all components of the drive or the control, which are located above or below the track of the car in known machine room-free elevator concepts, are installed next to the track of the elevator. Advantageously, the car is designed as a self-supporting car without a separate safety frame and with interception devices and cable pulleys integrated in the car base.

The integration of the cable pulleys into the car base is described in particular in EP 1 457 454 A1. According to the invention, the pulleys are integrated in the base or the ceiling of the elevator car between two metal plates. In the solutions disclosed there, the possibility exists that the car base or respectively the car ceiling with the integrated pulleys can be realized in a stiff, self-supporting sandwich design. The carrying and driving means can be located in an interior base duct or a ceiling duct. WO 2004/078628 A2 or EP 1 626 026 A2 describe similar solutions.

The disadvantages of the solutions with pulleys integrated in the car base are that the height of the car base is defined by the pulleys and carrying means it contains. The clearance for the pulleys in the car base must be at least as high as the pulleys, which means that the base must be higher than the pulleys. When using flat straps as carrying means, it is possible to use pulleys with a minimum diameter of 80 mm. The base is then at least 100 mm high.

In a standard configuration of the car buffer below the car base, a shaft pit with a depth of 200 mm can be realized, if forgoing an additional supporting frame. With a shaft pit of 200 mm, the building base must have a recess in the area of the elevator shaft, because the base of a building is usually not higher than 150 mm. The required recess in the base of the building requires a great deal of work when a building is constructed and is not feasible in some cases, for example when an elevator is installed in an existing building.

EP 1 818 303 A1 describes as a special embodiment that one or more additional distinct and spatially separated pulleys with separate axes are arranged inside the car along each carrying means cable directly subsequent to the pulley. In this embodiment, the two pulleys are arranged along an interior surface of the elevator car. The carrying means cables run through openings in the roof of the elevator car to the respective pulleys and from there upward to the elevator machine support frame.

In this application, the pulleys are fully in the car and therefore take up a lot of room in the passenger space. The cover that must be provided additionally to the other equipment in the car protrudes far into the car. Furthermore, it is an elevator using a rucksack suspension (pulleys located on one side of the car). In a one-sided suspension, the carrying structure, and in particular the ground level, must be significantly more stable and therefore larger due to the larger forces than they would have to be if a central suspension were used, because there is a distance between the center of gravity and the suspension point. Due to the larger forces between the guides and the guide rails, the effectiveness of such an elevator system is significantly lower than of an elevator with a central suspension.

SUMMARY

An object of the invention is to design a car for a preferably machine room-free elevator such that a shaft cross-section that is as large as possible can be made available to the passenger and the required shaft pit depth can be reduced to a minimum and/or the smallest possible shaft head height is required. The car width should be as large as possible with an equal shaft width.

The invention is realized by a car for an elevator in an elevator shaft, which is suspended substantially possible in the center of gravity thereof at least in a ratio of 2:1, i.e., in a central location. The car is guided via car guides. The car itself has a car roof, car walls, and a passenger space in-between that can be accessed by the passenger. According to the invention, at least one first part of a pulley is located in a region between the car base and the car roof and a second part of the pulley is located in the car base or at the same height as the car base or in the car roof.

The term "in the car base" or in the "car roof" refers to the arrangement of at least one pulley wherein, from a spatial perspective, the circumference of a pulley partially engages in a recess of the car base or the car roof, respectively, whereby the recess is always located in a central region of the car base or the car roof, respectively.

The two versions with a guide of the carrying means in the region of the car base and in the region of the suspended car ceiling can be realized with the invention. In the first version, the carrying means are guided below the car base or in the car base by means of pulleys; in the second version, they are guided below the car roof in a suspended ceiling.

Because the pulleys arranged in the region of the car base reach into the region between the car base and the car roof, the height of the car base can be reduced to the minimum dimensions that are required for its stability and, at the same time, the carrying means can be placed below or in the base. The height gained through the flat car base can be saved in the shaft pit depth. At the same time, the shaft head is minimal, because no pulleys are required above the car.

Because the pulleys arranged in the upper region of the car reach into the region between the car base and the car roof, the car base can be even smaller than in the first variation, because the carrying means now no longer need to be housed in the base region. The required shaft pit can be reduced here to approximately 125 mm. The pulleys integrated in the car ceiling and in the car roof now are con-structed only somewhat or not at all above the car. This has a favorable effect on the required shaft head height. At the same time, the required rope length is shorter than the carrying means guided in the region of the car base.

In a particularly preferred embodiment, a pulley consists of the first part and the second part, whereby the first part is located between the car base and the car roof and the second part inside a horizontal projection of the vertical extension of the car base. In such an embodiment, the pulley is completely integrated into the car, at least in the vertical direction. In this embodiment, therefore, no part of the pulley protrudes vertically downward from the car base. This leads to a particularly space-saving construction of the car. The required shaft pit can therefore be reduced further. The same applies accordingly to the space needed above the car when the pulleys are arranged in the area of the car roof.

In another embodiment, an axis of rotation of the pulley is located inside a horizontal projection of the vertical extension of the car base. The term "rotational axis" is defined here as a geometric axis of the pulley.

The protrusion of the pulley in the region between the car base and the car roof does not have a negative effect for the passenger, because a cover or specially designed car walls separate the accessible passenger space from the pulley. The separation is formed by installations located in the accessible passenger space, or covers are provided in peripheral regions that cannot be accessed anyway.

A preferred embodiment of the invention provides that the pulley is shaped by car walls formed toward the passenger space. The car walls are preferably shaped slightly toward the inside in the base or ceiling region so that the middle height of the passenger space is not impaired. The width that is available in the middle height of the passenger space is more important for the passenger's well-being than the base or ceiling region.

Another embodiment provides that the cover of the pulleys toward the interior of the passenger space is formed by at least a baseboard. Usually, there is a base-board anyway, which means that it does not impair the area perceived by the passenger.

By arranging the pulleys in the suspended ceiling, the passenger space is not impaired at all, because cars often have a suspended ceiling to house lighting elements. When using pulleys with a smaller diameter, the suspended ceiling does not have to be made larger than it already is for the lighting elements and the pulleys do not protrude above the car.

In one embodiment, the pulley can be accommodated in or respectively behind a control panel. The passenger needs control elements anyway, whereby the control panel is one way to provide such elements.

If the pulleys have covers toward the passenger space, it is easy to maintain and inspect the pulleys and the carrying means from within the passenger space. This has the advantage that the installer does not have to go into the shaft pit or onto the car roof, which constitute a higher risk area than the passenger space in the car.

One option provides that the car guides with the attachment elements are attached at least partially to a car wall and covered by a cover toward the interior of the passenger space so that they become invisible for the passenger.

If the carrying means are guided under the car base, it is advantageous if the height of the car base in the region of the carrying means is lower than that surrounding area of the car base. By making the car base thinner in the region of the elevator cables, the carrying means can be guided around the car without that additional space being required under the car base. The remaining base region is thicker and more stable. The floor thickness is adapted to the stress.

On the car buffers attached to the car base, the height of the car base may have a tapered shape in the regions of the car buffers as well. Buffers have a height specified by the manufacturer and a load-based spring compression. By tapering the base height in the area of the buffers, the buffers are only provided as much height as they actually need for their compression, which also reduces the shaft pit depth required for the car.

To achieve the shaft pit depth defined in the task, the car base must be extremely thick, whereby its carrying capacity in the traditional design does not suffice for the intended load. This is why one embodiment provides that the base must be reinforced at least partially by metal or plastic foams.

So as not to reduce the passenger area unnecessarily by the cover and/or to maintain the look in the passenger space, it makes sense to limit the pulley diameter to less than 200 mm. By selecting modern carrying means from thin, preferably plastic-coated ropes or flat belts, a small diameter of the pulleys, for example 80 mm, can be achieved.

It is particularly advantageous for the realization of the task if the car is self-supporting without a car frame, because the car frame would require additional space below, above, and/or next to the car.

If the carrying means are located in the region of the car base, the carrying means can be guided laterally along the outside of the car or, in a particular embodiment, at least partially in a region inside the car wall. The region between an existing panel inside and a panel fold-back is particularly suitable. This way, no space is required for the carrying means on the sides of the car. This reduces the required shaft width by at least 50 mm.

A particularly space-saving embodiment is achieved by arranging the pulleys in the region between the car space and the car roof so closely to the passenger space that they fit inside a box-shaped car region between the car base and the car roof with the outer edges of the box being congruent with the exterior outer edges of the car base. This way, the pulleys only take up very little space next to the car or only very little.

A similarly space-saving embodiment is achieved by arranging the pulleys in the region between the car space and the car roof so closely to the passenger space that they fit inside a box-shaped car region between the car base and the car roof with the outer edges of the box being congruent with the largest implementation of the interior walls of the car. This way as well, the pulleys only take up very little space next to the car.

The largest implementation is determined by projecting an imaginary center plane in the middle of the car vertically to the car base and substantially parallel to an outer edge of the car base into the car. Starting from this center plane, the furthest point that can be vertically projected on the car wall is determined for every interior wall of the car. The outer surfaces of the box are located parallel to the center plane and in the determined point.

DESCRIPTION OF THE DRAWINGS

Below, the invention is explained in further detail on the basis of several exemplary embodiments. The following is shown.

DETAILED DESCRIPTION

Figure 1:
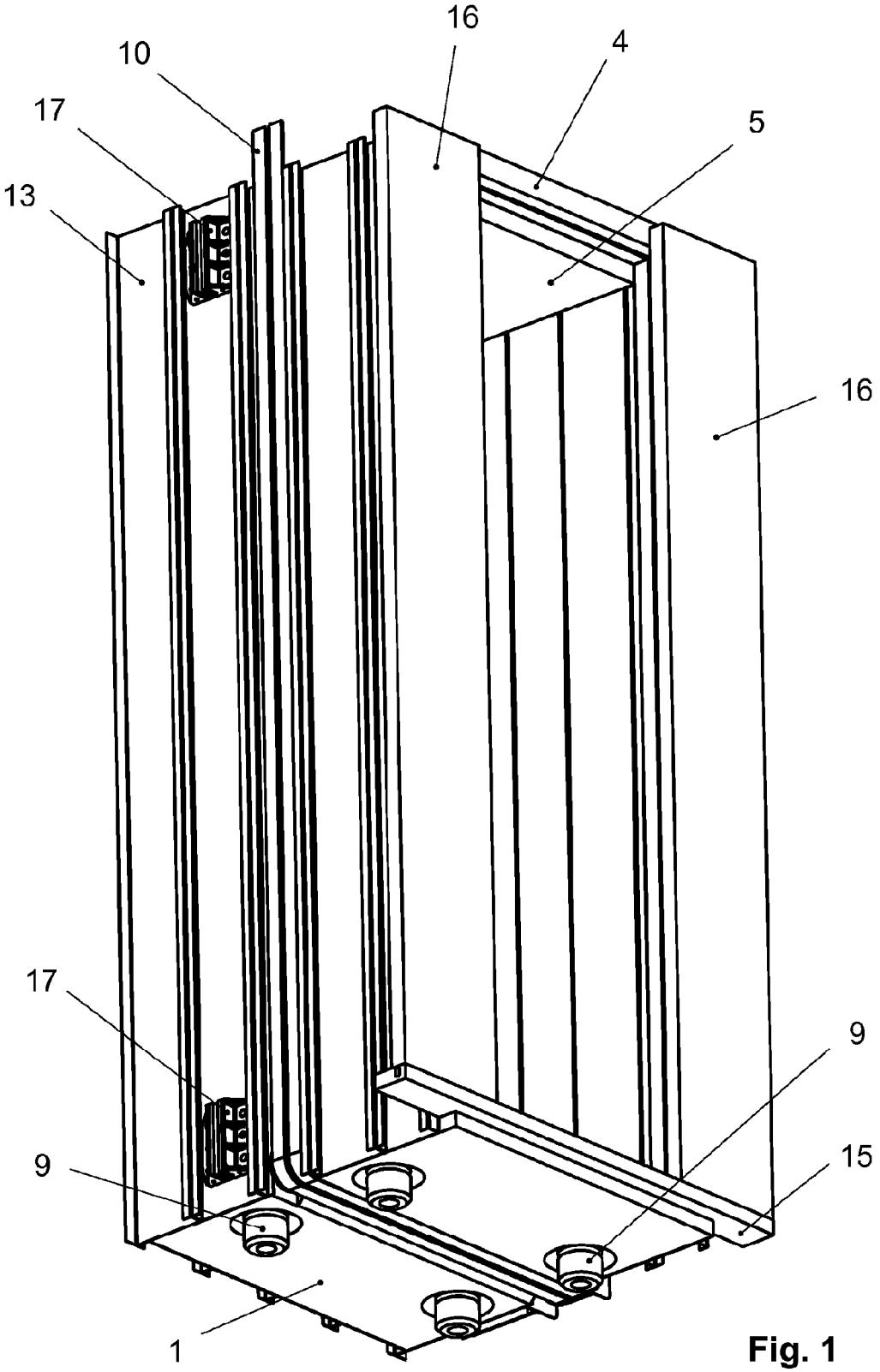
FIG. 1 is a perspective view of a car with carrying means that are located below the car base in a recess.
Figure 6:
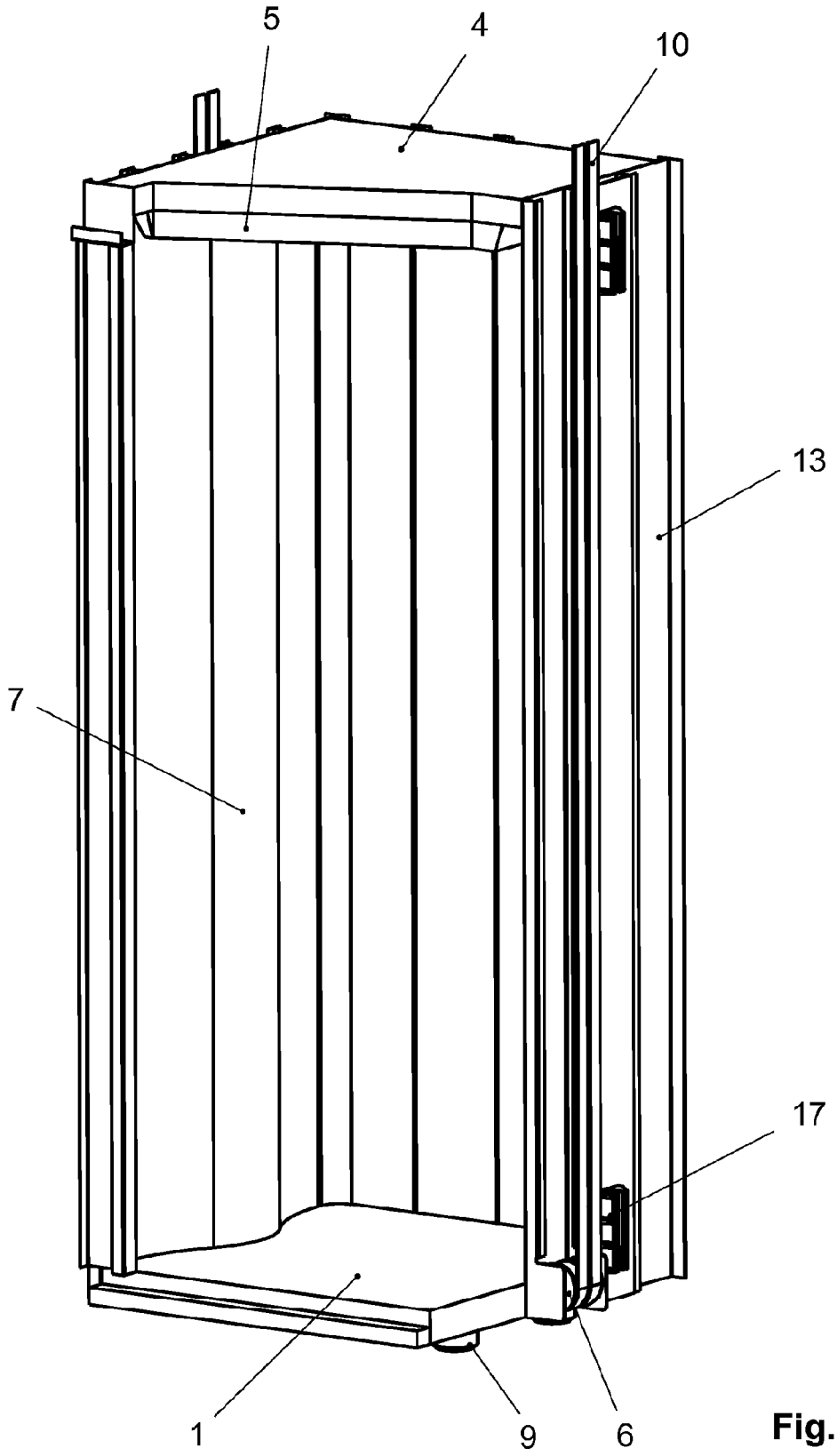
FIG. 6 is a perspective view of a car with undulated cover.

A first exemplary embodiment is shown in FIGS. 1 and 6. They show a car for an elevator which is suspended in its center of gravity in a ratio of 2:1 by means of carrying means or apparatus 10 guided via pulleys.

Figure 5:
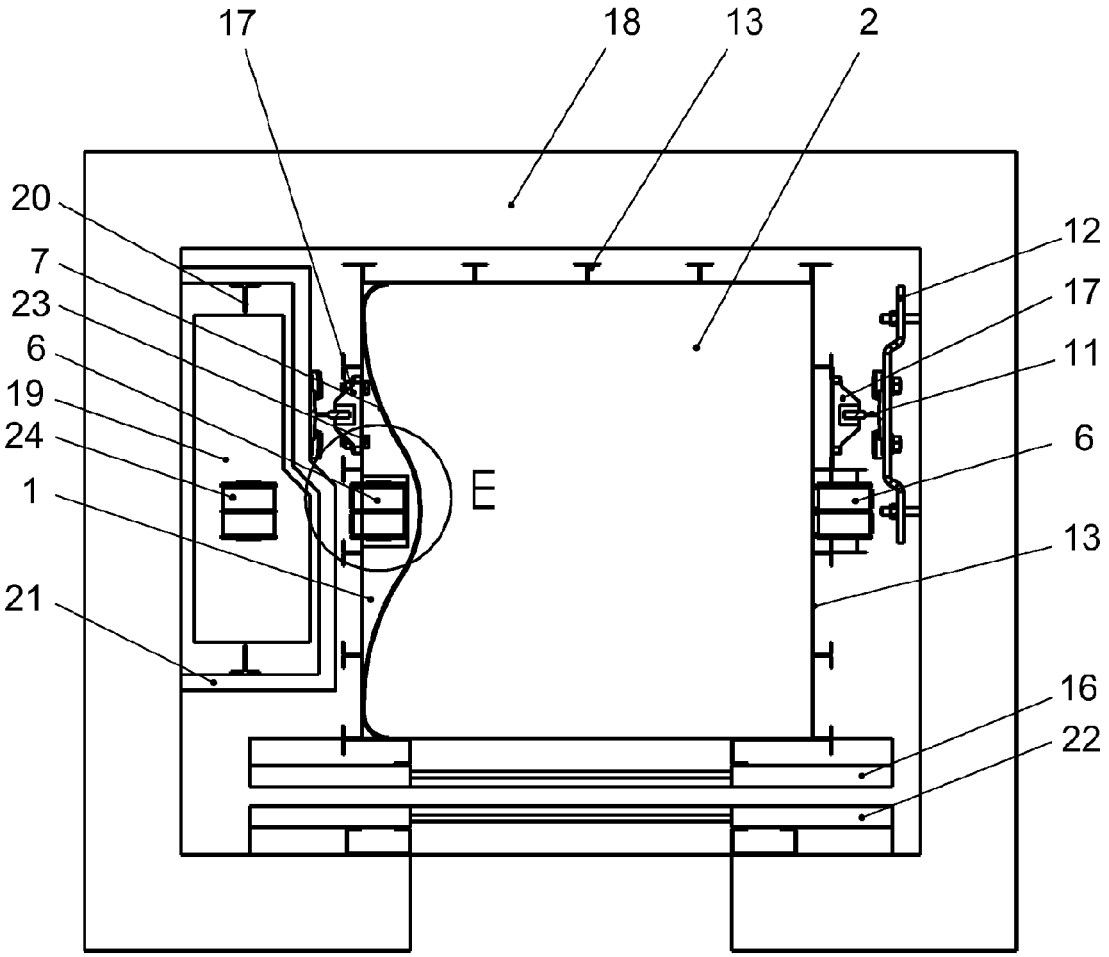
FIG. 5 is a top plan view of an elevator shaft with a car and its pulley, which is integrated in the car base and covered by an undulated cover.
Figure 9:
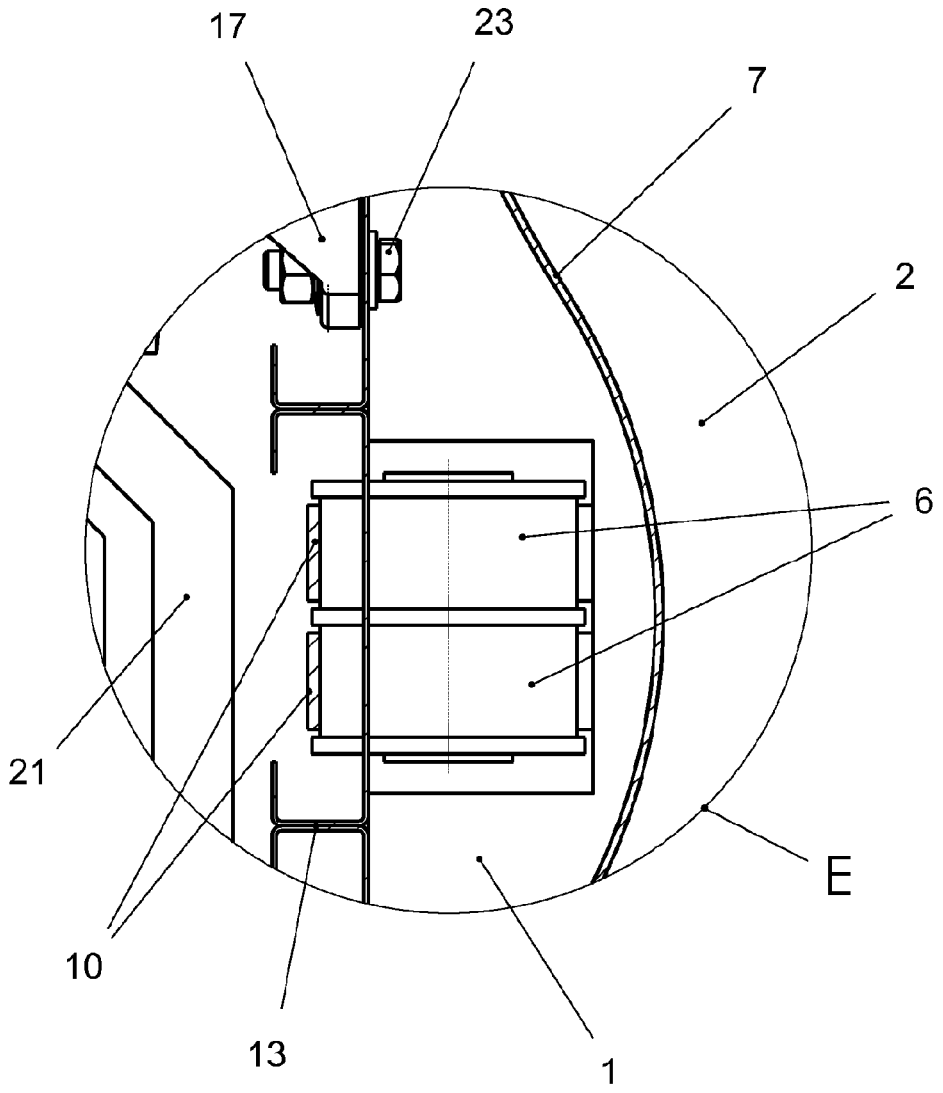
FIG. 9 shows Detail E from FIG. 5.

FIG. 5 shows this car in an elevator shaft 18 with the corresponding Detail E in FIG. 9. The top view shows how the car is guided by the car guides 17 in guide rails 11, which are attached to the elevator shaft 18 by means of rail brackets 12. The elevator shaft 18 also houses the counterweight 19, which is guided in counterweight guide rails 20, which are attached to the elevator shaft 18 with counterweight rail brackets 21. The counterweight 19 is suspended on the carrying means with the counterweight pulley 24 and includes a counterweight buffer 25.

The car has a car base 1 and a car roof 4, under which a suspended car ceiling 5 is located. The suspended car ceiling 5 contains, for example, the interior car lighting, which is not shown. The accessible passenger space 2 is delimited by car walls 13, an undulated cover 7, and a two-winged car door 16. It can be entered through the car door 16 which is arranged above a car door sill 15 when the car is adjacent a shaft door 22. The car walls 13 consist of several panels connected with each other through back-folds.

The carrying means 10 that are used here as flat belts run around the two pulleys 6 under the car base 1 and laterally along the car walls 13 and upward into the shaft head. The carrying means 10 run on one side to the drive and from there to the counterweight pulley 24 and from there again toward in the direction of the shaft head.

So that no additional space is required for the pulley 6 on the counterweight side in the cross-section of the shaft, one of the two pulleys 6 is arranged so closely to the middle of the car that its carrying means 10 can be guided upward in the car wall 13. FIG. 9 discloses this detail.

Since this car is designed for a shaft pit depth of 150 mm, some of the pulley 6 is integrated both in the car base 1 and some in the region between the car base 1 and the car roof 4. To ensure that the pulley does not interfere with the passenger space 2, it is covered by an undulated cover 7, which reaches from the car base 1 to the car roof.

The second pulley 6 on the opposite side of the car is arranged at the same height, but lateral to the car base 1. This version is chosen when the car wall 13 is to be straight on this side and the elevator shaft 18 has enough space for the pulley 6 at the side.

The attachment means 23, in this example screws, protrude from the panels to the center of the car. So that they are not noticed by the passenger, the undulated cover 7 is to be designed in such a way that these screws as well as the pulley 6 on the counterweight side are covered.

Recesses are formed in the car base 1, and four car buffers 9 are inserted in these. Another recess in the car base 1 is provided for the carrying means 10.

Overall, the special arrangement and selection of the required components, particularly the pulleys 6, the carrying means 10, and the car buffers 9, make it possible to reduce the required space under the floor for passengers to a minimum and achieve a shaft pit depth of 150 mm. The required shaft width is much smaller than for currently known solutions. So that the advantages of the compact construction can be fully utilized, the car is preferably provided for machine room-less elevators.

Figure 2:
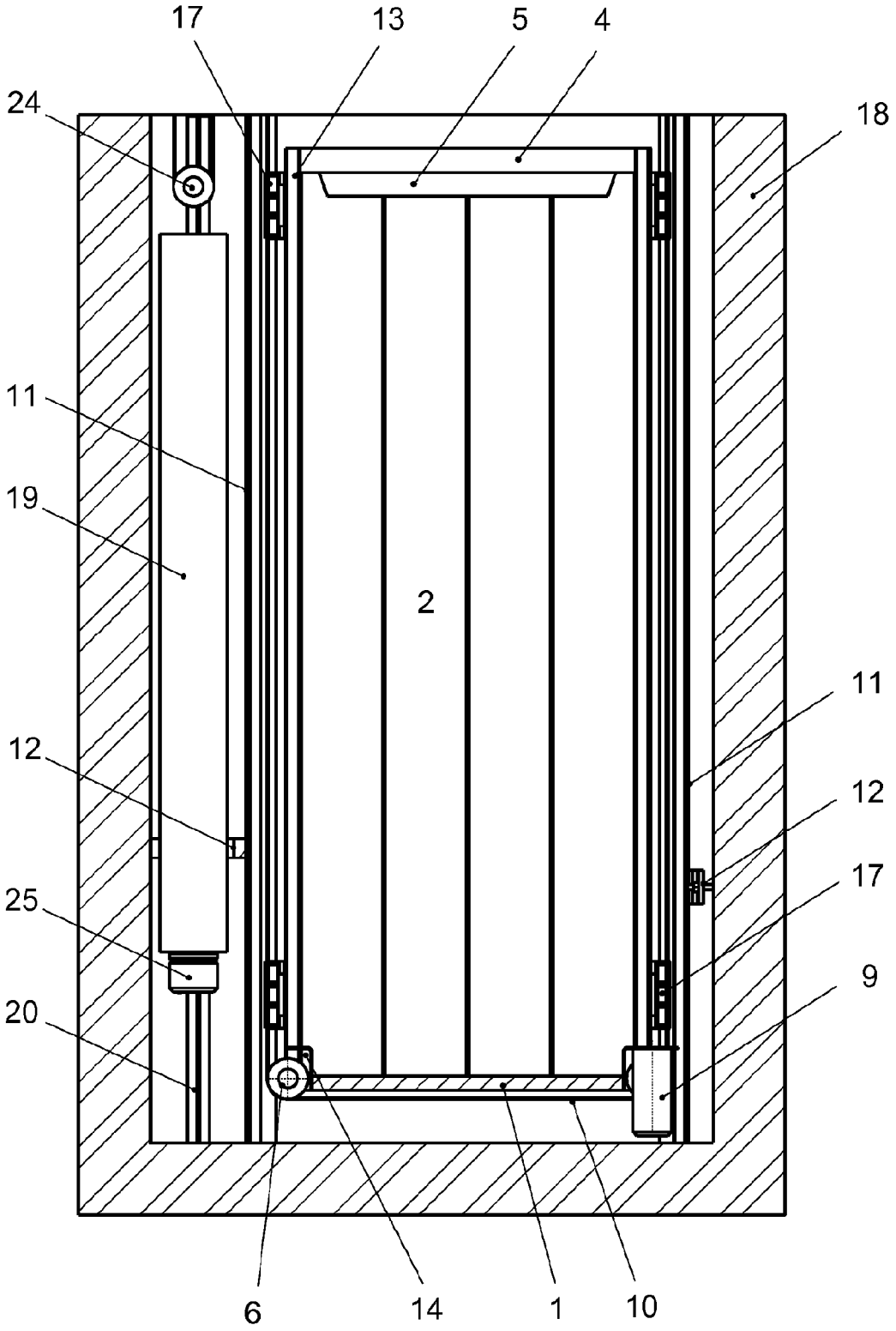
FIG. 2 is an elevation view of a car with carrying means that are located below the car base.

In FIG. 2, the version shown in FIGS. 1, 5, and 9 has been modified in that the over-all car base 1 is even thinner and does not have a recess for the carrying means 10. The carrying means run below the base. Both pulleys 6 have been moved so far in the direction of the center of the car that the shaft width can be even smaller. Both pulleys 6 are covered by baseboards 14. The car buffers 9 are arranged on the side so that they partially protrude over the car base 1. Therefore, it is possible to use long car buffers 9 as well. The very thin car base 1 consists, for example, of two plates, and the space between them is filled with aluminum foam for reinforcement purposes.

Figure 3:
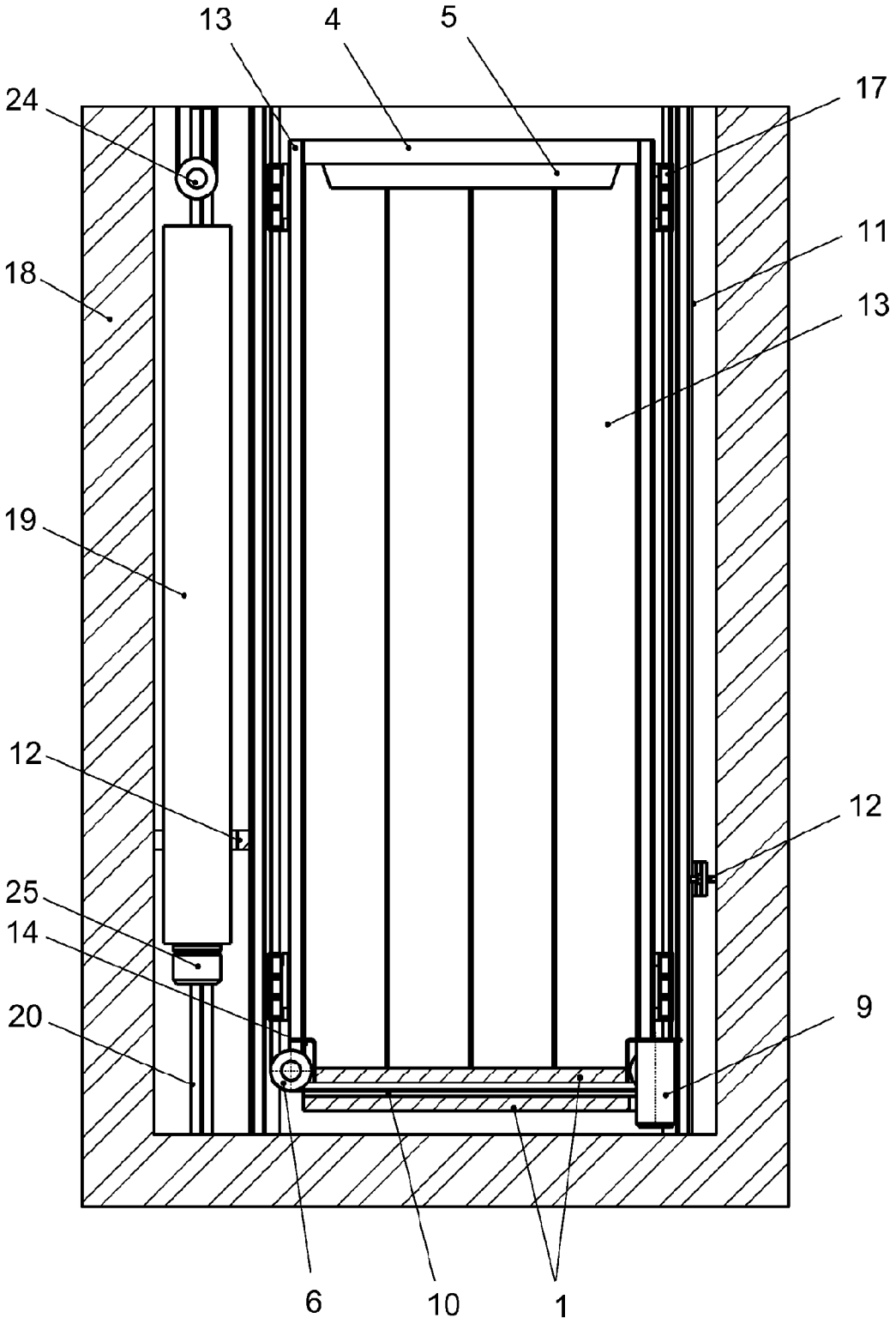
FIG. 3 is an elevation view of a car with carrying means that are located in the car base.

The exemplary embodiment in FIG. 3 is different from those above in that the carrying means 10 are not guided under the car base 1, but in the car base 1 in a duct from one side of the car to the other.

Figure 4:
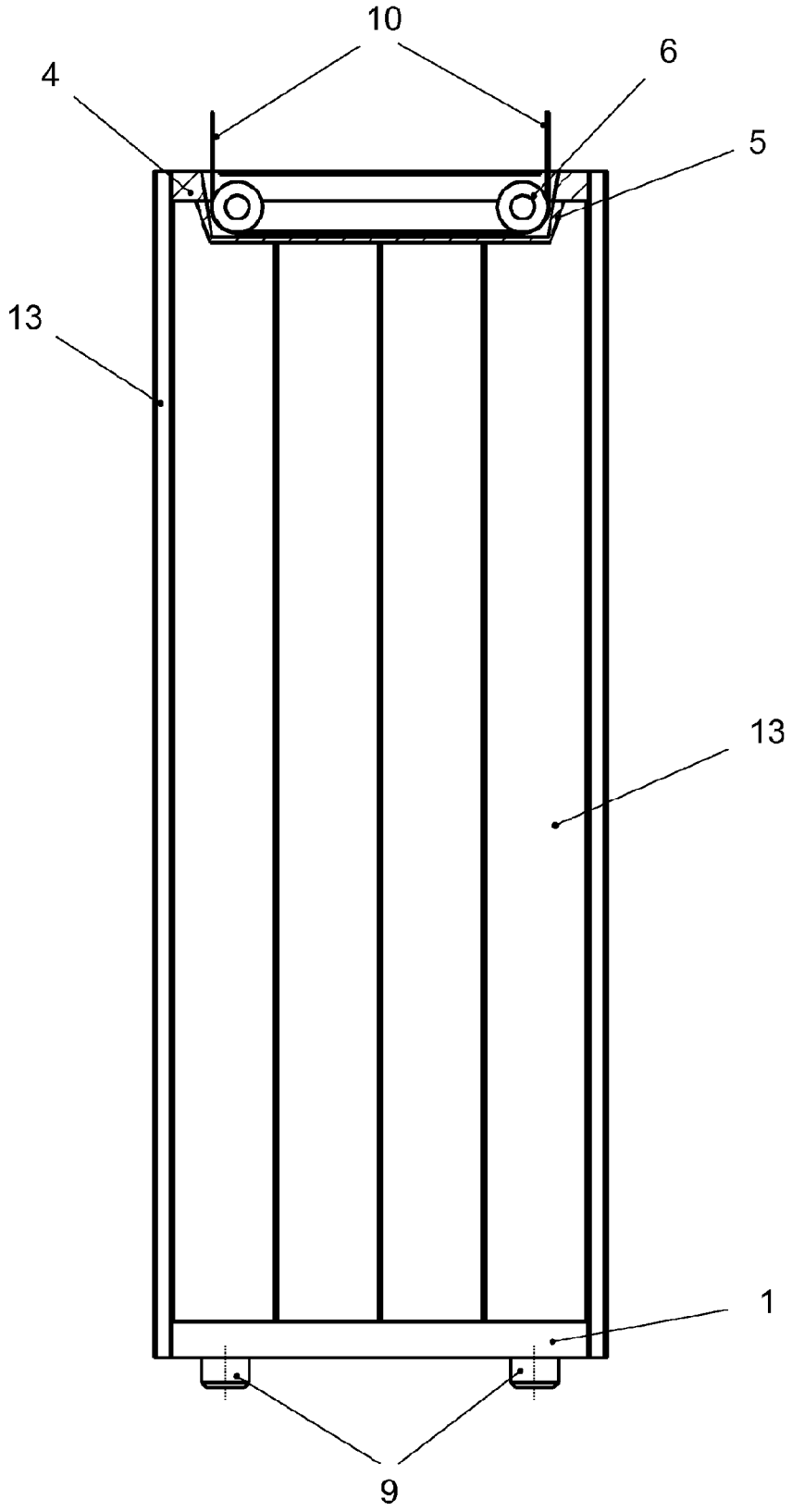
FIG. 4 is an elevation view of a car with carrying means located in the suspended car ceiling.

In an exemplary embodiment shown in FIG. 4, the pulleys 6 are arranged in such a way that the carrying means 10 run below the car roof 4. The pulleys 6 protrude here only so far into the region between the car roof 4 and the car base 1 that they can still be accommodated in the suspended car ceiling 5. The pulleys 6 used here have a diameter of 80 mm. They can therefore be fully accommodated in the car roof 4 with a thickness of 50 mm and the suspended car ceiling 5, which has a thickness of 50 mm as well.

Since the pulleys 6 do not protrude upward past the roof, the required shaft head is only determined by the components in the shaft head that are independent from the car and by the car height, and not by the pulleys 6. This special arrangement of the pulleys 6 makes it possible to reduce the required space above the car roof 4 to a minimum.

Figure 7:
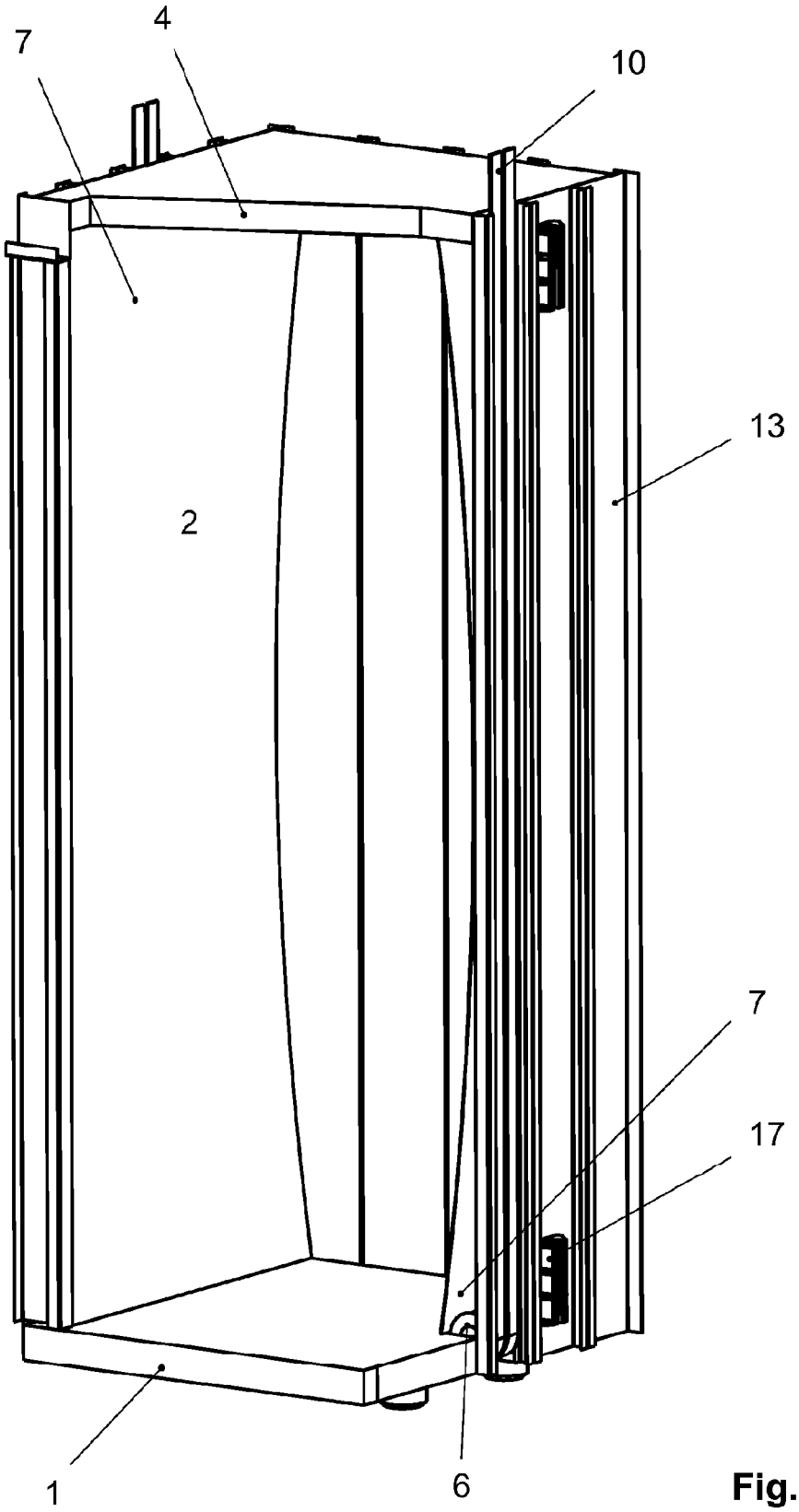
FIG. 7 is a perspective view of a car with oval covers.
Figure 8:
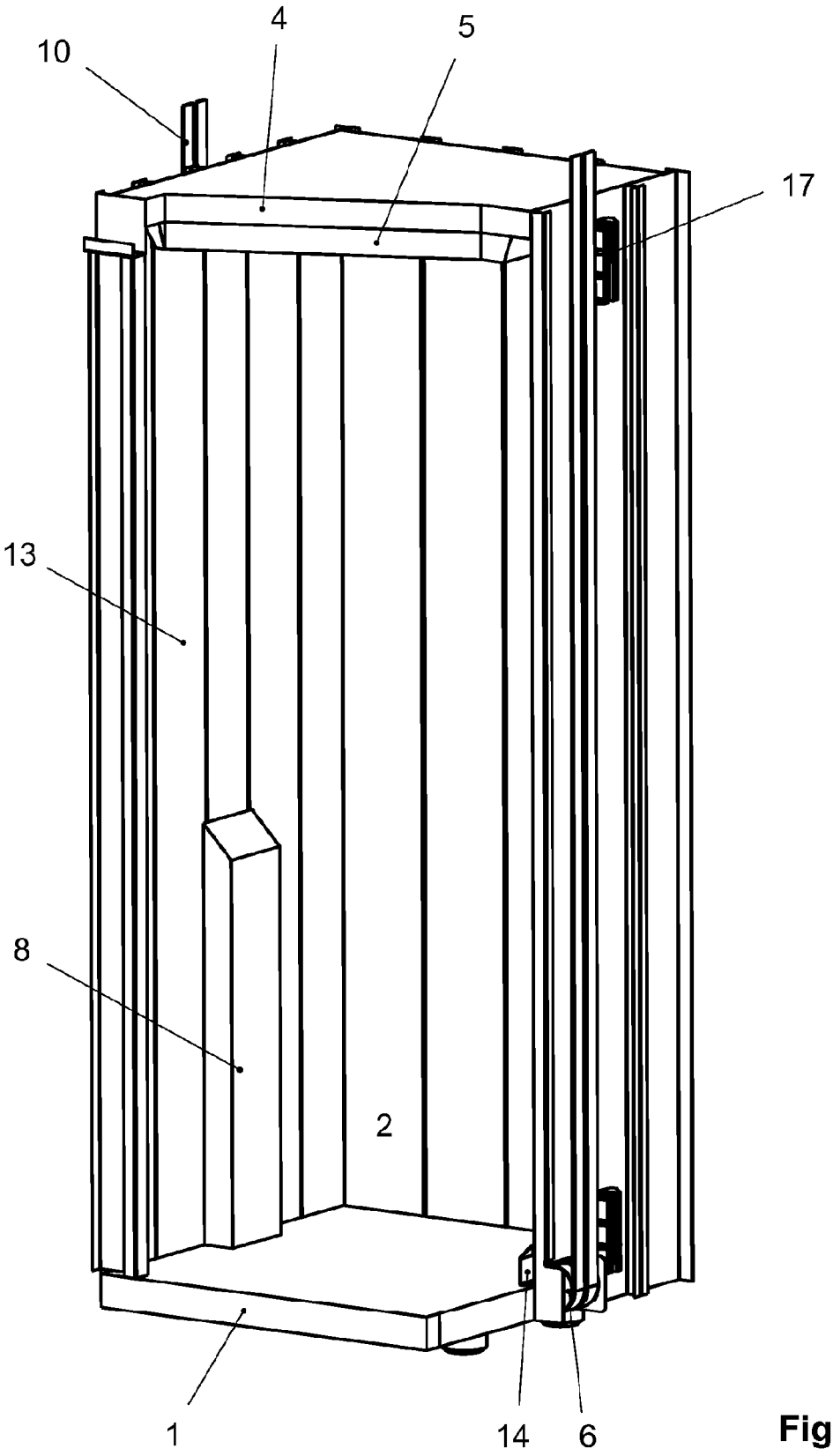
FIG. 8 is a perspective view of a car with control panel and baseboard as covers.

FIGS. 7 and 8 show two possibilities how the cover 7 of the pulleys 6 can be realized in such a simple way that passengers are impaired as little as possible.

In FIG. 7, the cover 7 of the passenger space 2 is arched in an oval shape such that at least the part of the pulley 6 that protrudes into the region between the car roof 4 and the car base 1 is covered by the cover 7 and therefore not noticed by the passenger. The oval shaping of the passenger space 2 can preferably occur only on the side, either at the top or the bottom, where the pulleys 6 reach into the passenger space 2.

In FIG. 8, a required control panel 8 is used in the passenger space 2 to serve as a cover 7 for the part of the pulley 6 that protrudes into the passenger space 2. On the opposite side, the part of the pulley 6 that protrudes into the passenger space 2 is covered by a baseboard 14.

Figure 10:
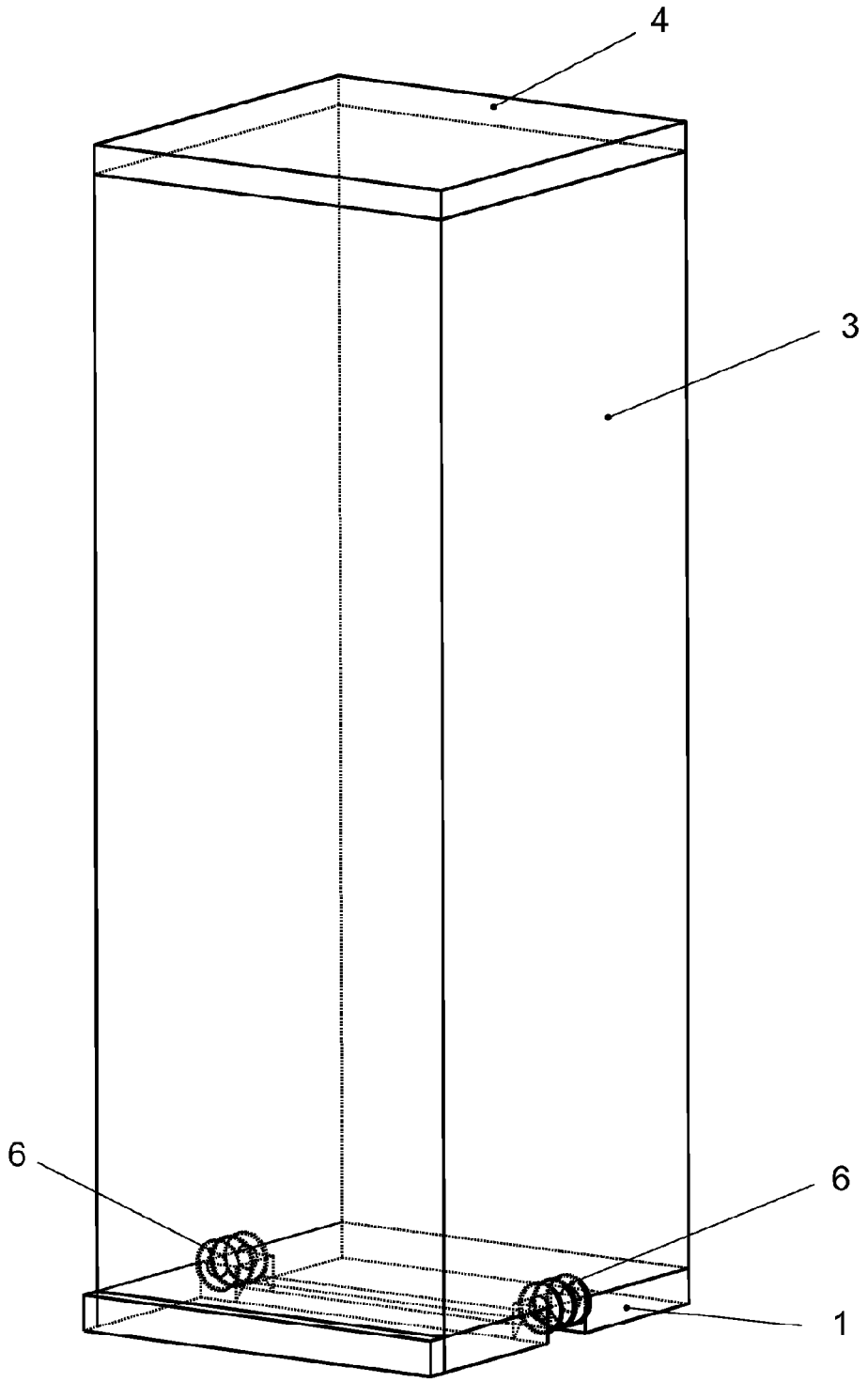
FIG. 10 is an Illustration of the box-shaped car region, with the outer edges being congruent with the outer edges of the car.

FIG. 10 illustrates the box-shaped car region 3 between the car base 1 and the car roof 4 in which the pulley 6 is located, in which the outer edges of the box 3 are congruent with the outer edges of the car base 1.

Figure 11:
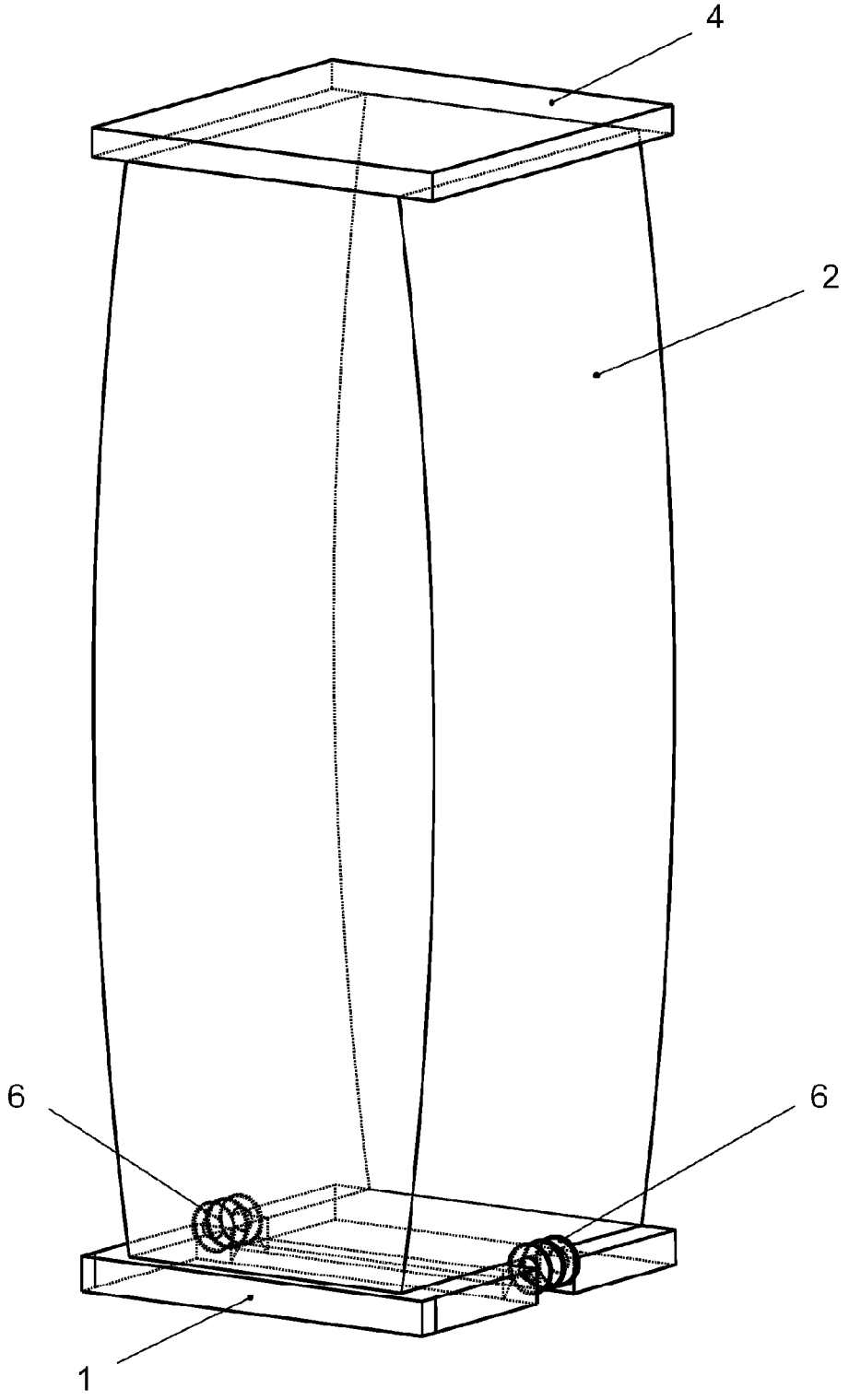
FIG. 11 is an Illustration of the passenger space when using concave covers.

FIG. 11 illustrates which area below the passenger space is referred to in the exemplary embodiment with an oval cover 7.

Figure 12:
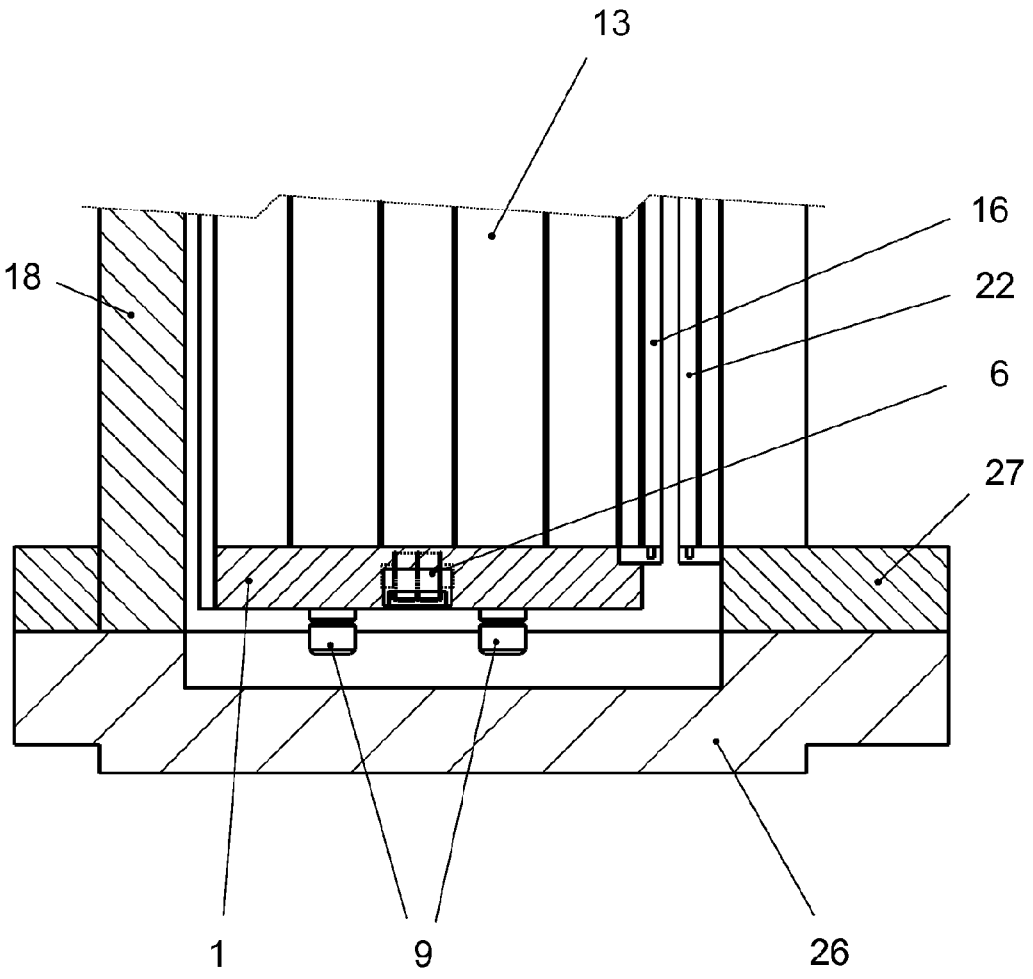
Fig. 12 (Prior Art)
FIG. 12 is a cross-sectional view of an elevator shaft with a car in which the pulleys are arranged in the car base according to the prior art.

FIG. 12 shows a cross-section through an elevator shaft 18 with a car in which the pulleys 6 are arranged in the car base 1 according to prior art and therefore illustrates that the required shaft pit depth is greater than 150 mm. The building plate 26 is perforated for the elevator shaft 18.

Figure 13:
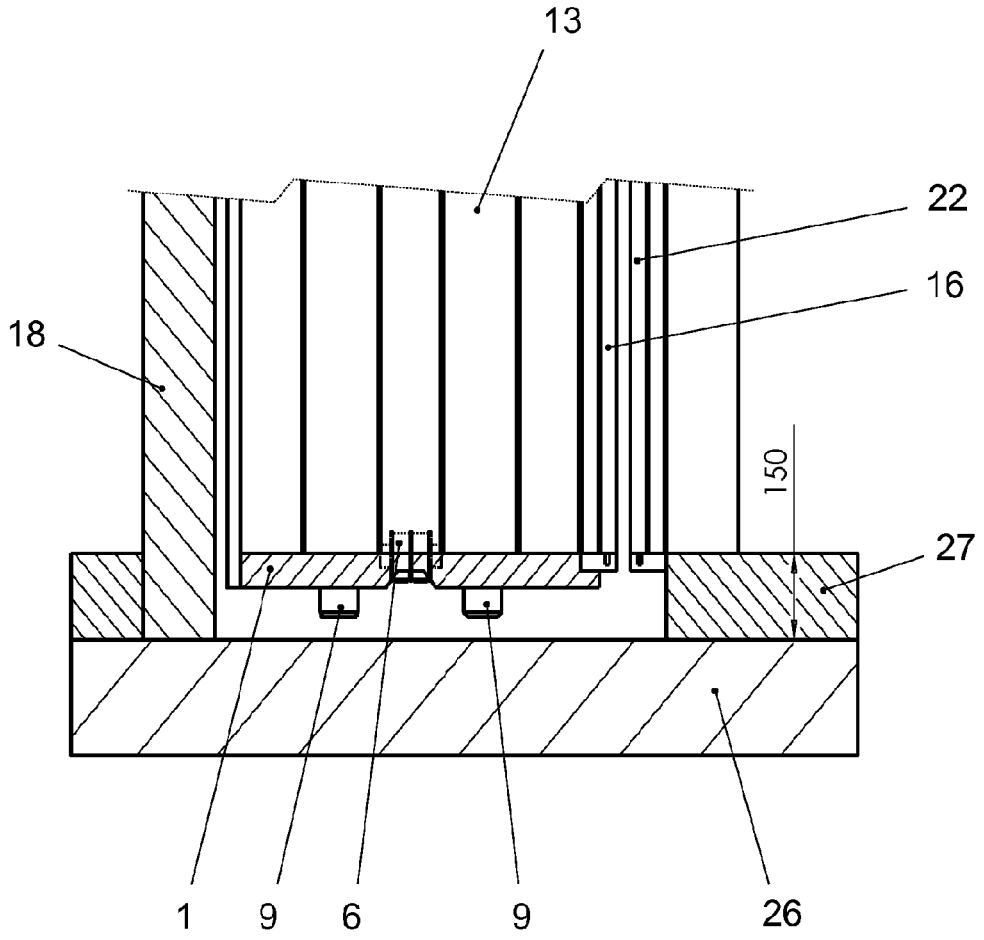
FIG. 13 is a cross-sectional view of an elevator shaft with a car in which one part of the pulleys is arranged in the car base and a second part above the car base.

FIG. 13 shows a cross-section through an elevator shaft 18 with a car in which one part of pulleys 6 is arranged in the car base 1 and a second part above the car base 1. It is clear that the invention only requires a shaft pit depth of 150 mm. The building plate 26 does not have to be perforated, because the building base 27 is 150 mm high.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE NUMBERS

1 Car base
2 Passenger space
3 Box-shaped car region
4 Car roof
5 Suspended car ceiling
6 Pulley
7 Cover
8 Control panel
9 Car buffer
10 Carrying means
11 Guide rail
12 Rail bracket
13 Car wall
14 Baseboard
15 Car sill
16 Car door
17 Car guide
18 Elevator shaft
19 Counterweight
20 Counterweight guide rail
21 Counterweight rail bracket
22 Shaft door
23 Attachment element
24 Counterweight pulley
25 Counterweight buffer
26 Base slab of the building
27 Building base

The invention claimed is:

1. A car for an elevator in an elevator shaft, which car is suspended at a center of gravity thereof at least in a ratio of 2:1 by a carrying apparatus guided via pulleys, and which car is guided via car guides, wherein the car includes a car base, a car roof and car walls enclosing a passenger space that can be accessed by a passenger, the passenger space having a floor positioned at a top surface of the car base, comprising: a first part of a one pulley of the pulleys is located in a region above the floor and below the car roof and a second part of the one pulley is located in the car base.

2. The car according to claim 1 wherein the first part of the one pulley is located in a region above the floor and below the car roof and the second part of the one pulley is inside a horizontal projection of a vertical extension of the car base.

3. The car according to claim 1 wherein an axis of rotation of the one pulley is located inside a horizontal projection of a vertical extension of the car base.

4. The car according to claim 1 including a cover separating the one pulley from the accessible passenger space.

5. The car according to claim 1 wherein the carrying apparatus extends below the car base or through the car base and is guided from one side of the car to an opposite side of the car by the pulleys.

6. The car according to claim 1 wherein at least one of the car walls, a formed cover, a baseboard, or a control panel separates the one pulley from the passenger space.

7. The car according to claim 1 wherein the one pulley is located in a box-shaped car region in a region above the floor and below the car roof, with outer edges of the box-shaped car region being congruent with exterior outer edges of the car base.

8. The car according to claim 1 wherein the one pulley is located in a box-shaped car region in a region the floor and below the car roof, with outer edges of the box-shaped car region being congruent with a largest expression of inside walls of the car.

9. The car according to claim 1 wherein an outer height of the car base tapers out in a region of at least one of the carrying apparatus and a car buffer attached to the car.

10. The car according to claim 1 wherein the car is configured as self-supporting without a car frame.

11. The car according to claim 1 wherein a cover separates the one pulley from the passenger space and the cover is removable.

12. The car according to claim 1 wherein the carrying apparatus is arranged laterally next to the car at least partially in a region within one of the car walls.

13. A car for an elevator in an elevator shaft, which car is suspended at a center of gravity thereof at least in a ratio of 2:1 by a carrying apparatus guided via pulleys, and which car is guided via car guides, comprising:

a car base;

a car roof;

car walls cooperating with the car base and the car roof to enclose a passenger space that can be accessed by a passenger, the passenger space having a floor positioned at a top surface of the car base; and wherein a first part of each of the pulleys is located in a region above the floor and below the car roof and a second part of each of the pulleys is located in the car base.

* * * * *